US010246890B2

(12) United States Patent
Booker et al.

(10) Patent No.: US 10,246,890 B2
(45) Date of Patent: Apr. 2, 2019

(54) COLLAPSIBLE AND PORTABLE LACTATION ENCLOSURE

(71) Applicants: WORKNEST LLC, Bebanon, NJ (US); William R. Booker, Chatham, NJ (US); Tazha Perez, Lebanon, NJ (US)

(72) Inventors: William R. Booker, Chatham, NJ (US); Tazha Perez, Lebanon, NJ (US)

(73) Assignee: WORKNEST LLC, Lebanon, NJ (US)

( * ) Notice: Subject to any disclaimer, the term of this patent is extended or adjusted under 35 U.S.C. 154(b) by 0 days.

(21) Appl. No.: 15/101,319

(22) PCT Filed: Dec. 3, 2014

(86) PCT No.: PCT/US2014/068291

§ 371 (c)(1),
(2) Date: Jun. 2, 2016

(87) PCT Pub. No.: WO2015/084918

PCT Pub. Date: Jun. 11, 2015

(65) Prior Publication Data

US 2016/0312486 A1 Oct. 27, 2016

Related U.S. Application Data

(60) Provisional application No. 61/911,025, filed on Dec. 3, 2013.

(51) Int. Cl.

| | |
|---|---|
| ***E04H 1/00*** | (2006.01) |
| ***E04H 1/12*** | (2006.01) |
| ***A47B 3/14*** | (2006.01) |
| ***A47B 5/00*** | (2006.01) |
| ***E04B 1/343*** | (2006.01) |
| ***F21S 11/00*** | (2006.01) |

(52) U.S. Cl.

CPC ..... *E04H 1/1266* (2013.01); *A47B 3/14* (2013.01); *A47B 5/00* (2013.01); *E04B 1/34321* (2013.01); *E04H 1/125* (2013.01); *F21S 11/007* (2013.01)

(58) Field of Classification Search

CPC ..... E04H 1/1266; E04H 1/125; A47B 3/14; A47B 5/00; F21S 11/007; E04B 1/34321

USPC ..... 52/79.5, 79.1, 79.6, 36.1; 4/449, 460; 244/118.5

See application file for complete search history.

(56) References Cited

U.S. PATENT DOCUMENTS 1,480,145 A * 1/1924 Berven ..... A47K 1/02 296/152

1,857,913 A 5/1932 Judelson (Continued)

OTHER PUBLICATIONS

International Search Report and Written Opinion of PCT/US14/68291, dated Mar. 5, 2015.

(Continued)

*Primary Examiner* — Basil S Katcheves

(74) *Attorney, Agent, or Firm* — Reed Smith LLP

(57) ABSTRACT

A portable, collapsible, private and secure lactation enclosure for use by working mothers who would like to comfortably express milk at work using a breast pump or breastfeed their baby. The lactation enclosure is a relatively lightweight rectangular unit with readily collapsible walls, floor, and screened ceiling, allowing for ventilation and ambient light. The interior is light, secure, roomy and inviting for the mother and includes seating for the mother, and a table and electrical outlet for a pump.

5 Claims, 7 Drawing Sheets

(56) References Cited

U.S. PATENT DOCUMENTS

| | | | | | |
|---|---|---|---|---|---|
| 2,820,256 | A | | 1/1958 | Dahl | |
| 3,873,445 | A | * | 3/1975 | Bussard | C02F 1/76 210/149 |
| 4,065,885 | A | | 1/1978 | Blick et al. | |
| 4,380,836 | A | | 4/1983 | Braxton | |
| 4,446,585 | A | * | 5/1984 | Harding | E04H 1/1216 4/460 |
| 4,493,118 | A | * | 1/1985 | Braxton | A47K 3/32 4/449 |
| 4,918,765 | A | * | 4/1990 | Harding | E04H 1/1216 4/460 |
| 4,957,323 | A | | 9/1990 | Johnson | |
| 5,560,050 | A | * | 10/1996 | Tagg | E04H 1/1216 4/449 |
| 5,742,956 | A | * | 4/1998 | Tarver | A47K 4/00 4/644 |
| 6,003,271 | A | | 12/1999 | Boyer et al. | |
| 6,178,701 | B1 | | 1/2001 | De Paepe et al. | |
| 6,427,256 | B1 | | 8/2002 | Mullett et al. | |
| 6,615,421 | B2 | * | 9/2003 | Itakura | B64D 11/02 244/118.5 |
| 6,721,967 | B2 | | 4/2004 | Braxton | |
| 7,364,119 | B2 | * | 4/2008 | Sprenger | B64D 11/00 244/118.6 |
| 7,690,159 | B1 | | 4/2010 | Arnold | |
| 2012/0260831 | A1 | | 10/2012 | McCarty | |

OTHER PUBLICATIONS

Corrected International Search Report for PCT/US14/68291, dated Mar. 17, 2015.

Privee Designs [http://www.priveedesigns.com.lactating-rooms/] dated Sep. 6, 2013.

Mamava Solutions [http://www.mamava.com/portfolio/mamava-solutions/the-mamava-lactation-station/] dated Sep. 6, 2013.

* cited by examiner

COLLAPSIBLE AND PORTABLE LACTATION ENCLOSURE

CROSS-REFERENCE TO RELATED APPLICATION

This application is a United States national stage of International Application No. PCT/US14/68291, filed Dec. 3, 2014, which was published as International Publication No. WO 2015/084918, and which claims the benefit under 35 U.S.C. § 119(e) of the earlier filing date of U.S. Provisional Patent Application No. 61/911,025 filed on Dec. 3, 2013, the disclosure of which is incorporated by reference herein.

BACKGROUND

This application discloses an invention which is related, generally and in various embodiments, to a portable, collapsible, private and secure enclosure for use by working mothers who would like to comfortably express milk at work using a breast pump or nurse their baby.

Breastfeeding has been shown to have increased health benefits to babies. Working mothers who would like to continue to breastfeed after going back to work may face an unsupportive work environment. Typically, nursing mothers may require multiple breaks throughout the day to express breast milk with a breast pump at work in order to feed their babies with the expressed milk later. One difficulty working mothers face is finding a clean and private place to use as a pumping station or lactation room while at work. Some states now require that businesses provide lactation rooms for mothers. Employers may face costly construction in order to adapt their facilities to comply with these requirements. Construction of permanent on-site lactation facilities can be messy and inconvenient. A need exists, therefore, for convenient, portable and economical lactation accommodations.

DETAILED DESCRIPTION

Figure 1:
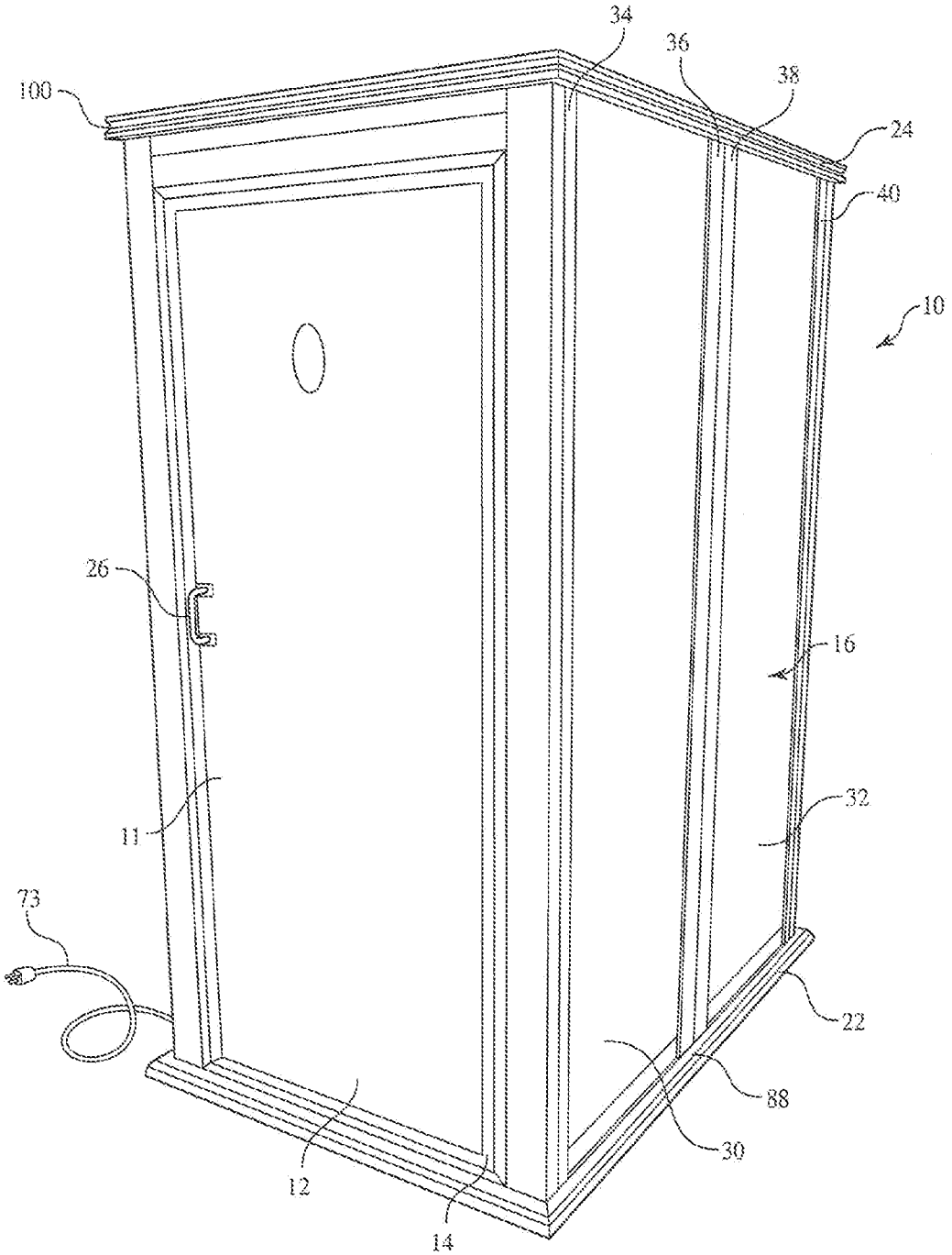
FIG. 1 shows a perspective view of the lactation enclosure with door assembly closed according to embodiments of the invention.

Referring to the drawings, there are shown embodiments of a portable, collapsible, private and secure lactation room or enclosure 10 for use by working mothers who would like to comfortably express milk at work or other places using a breast pump. Lactation enclosure 10 may also be used by mothers to breastfeed their baby. Lactation enclosure 10 is relatively lightweight rectangular unit with readily collapsible walls, floor, and screened ceiling, allowing for ventilation and ambient light. The interior is light, secure, roomy and inviting for the mother and includes seating 66 for the mother, and a table 72 supported by bracket 70 and electrical outlet 68 for a pump.

Referring now in detail to FIGS. 1-11, the lactation enclosure 10 according to embodiments of the invention includes a front panel 11 having a door assembly 12 and a door frame 14, first and second side panel assemblies 16, 18, a rear panel 20, a base 22, and a ceiling unit 24.

Figure 2:
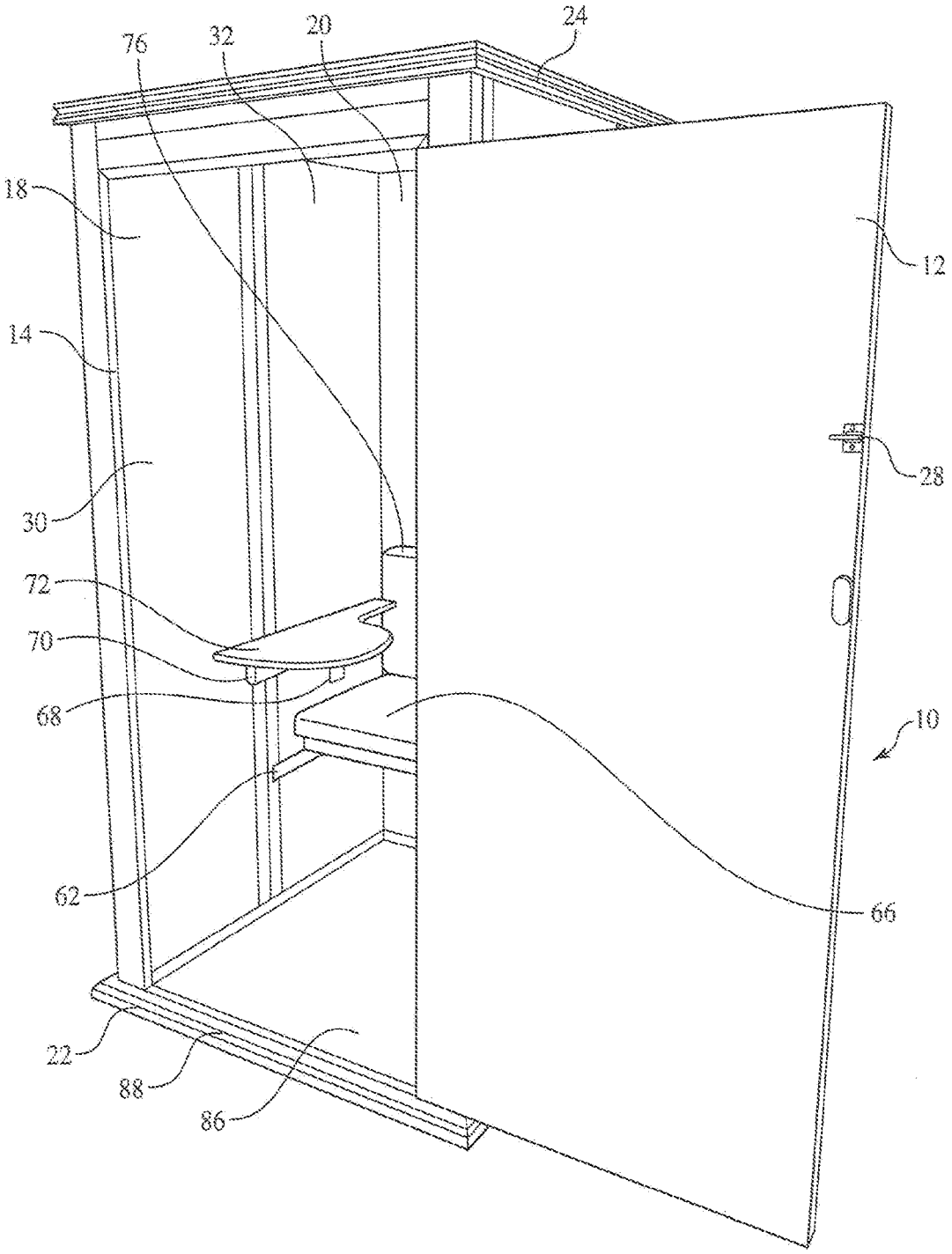
FIG. 2 shows a perspective view of the lactation enclosure of FIG. 1 with door assembly open.
Figure 3:
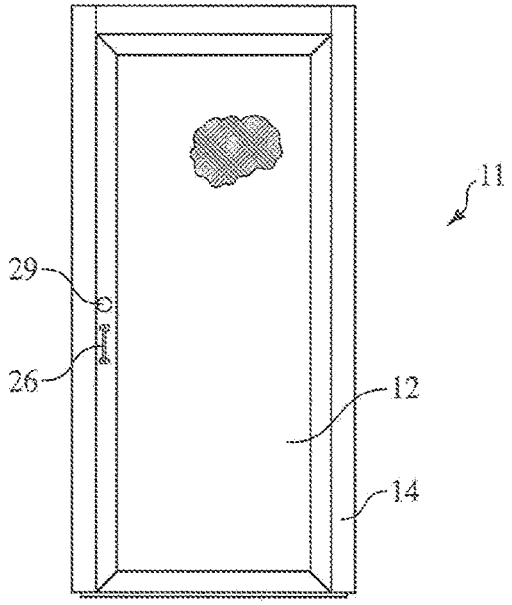
FIG. 3 shows an exterior view of the front panel including a door assembly and door frame according to embodiments of the invention.
Figure 4:
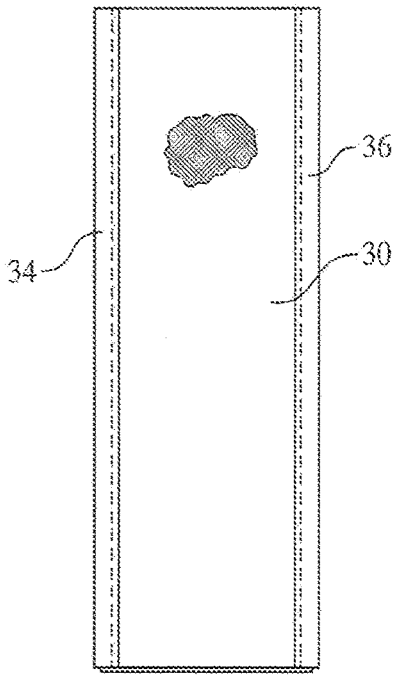
FIG. 4 shows an exterior view of a side panel according to embodiments of the invention.
Figure 5:
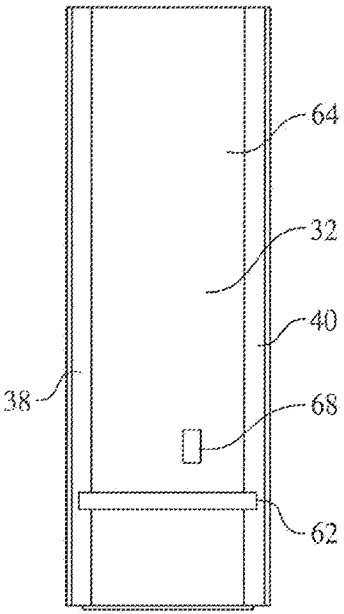
FIG. 5 shows an interior view of a side panel according to embodiments of the invention.

Front panel 11 including the door assembly 12 and door frame 14 are shown in FIG. 3. A full length piano hinge (not-illustrated) pivotally secures the door assembly 12 to the door frame 14. Door assembly 12 further includes a swivel door handle 26 and an interior lock 28 (FIG. 2). Door assembly 12 also preferably has a vacancy indicator 29.

Figure 6:
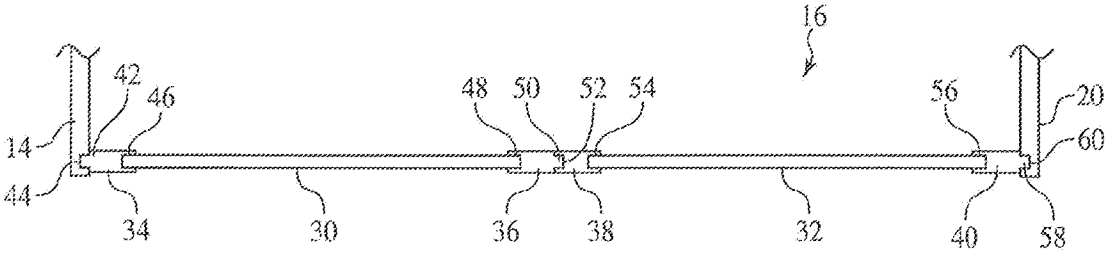
FIG. 6 shows a top view of a side panel assembly according to embodiments of the invention.
Figure 7:
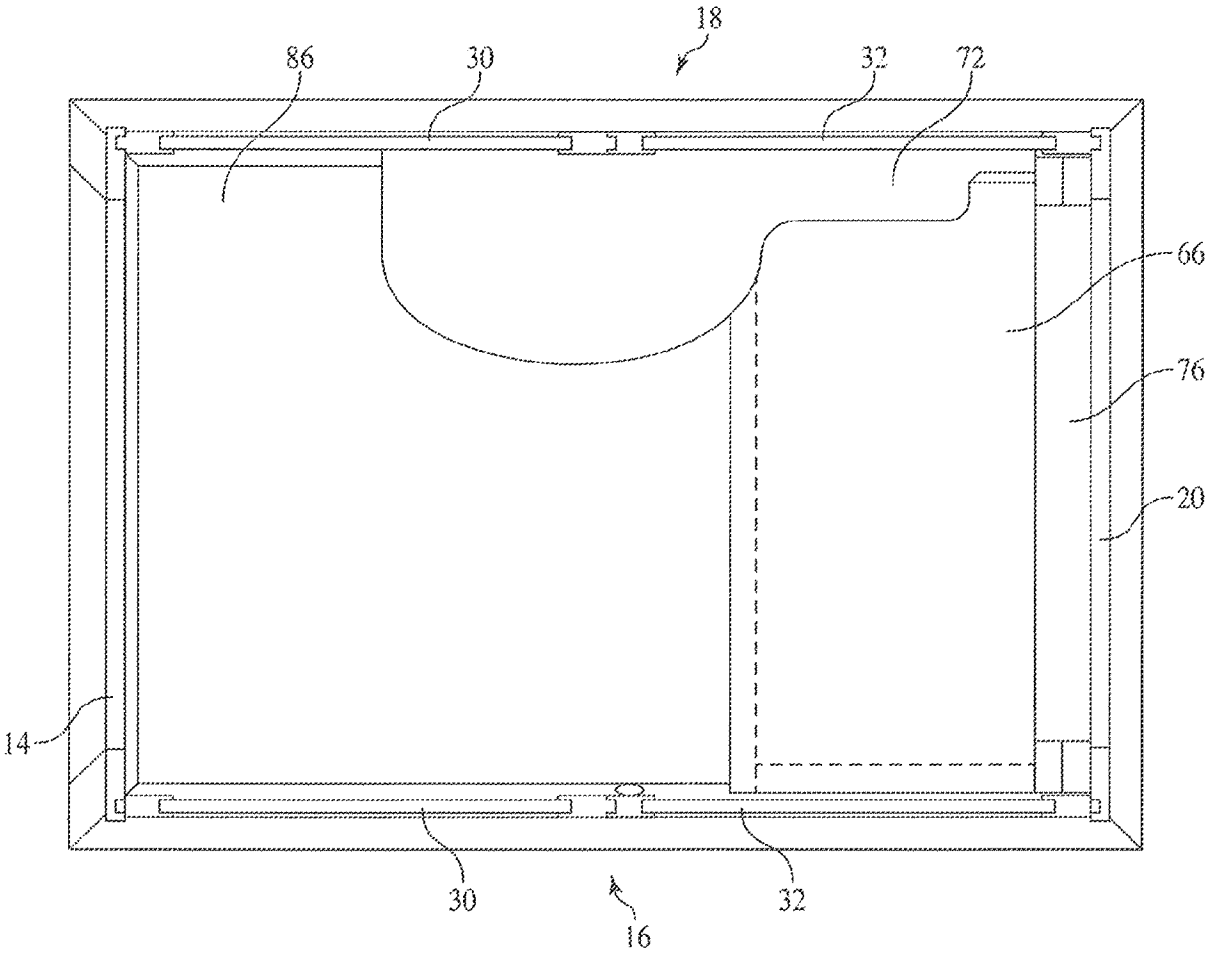
FIG. 7 shows a top view of the lactation enclosure with ceiling unit removed according to embodiments of the invention.
Figure 8:
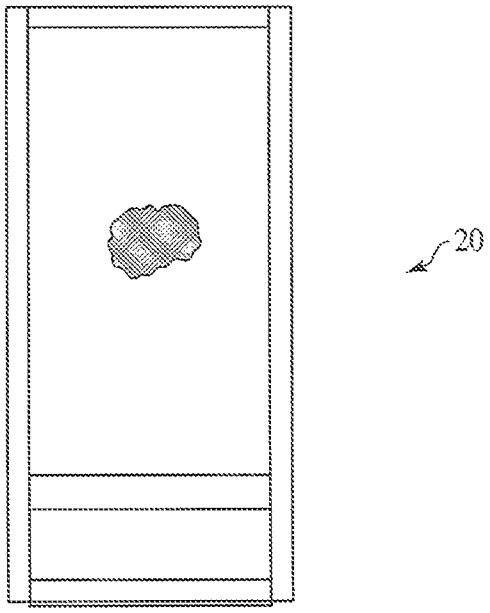
FIG. 8 shows an exterior view of the rear panel according to embodiments of the invention.

Referring to FIGS. 1 and 6, each of the first and second side panel assemblies 16, 18 includes first and second side panels 30, 32 which are connectable to each other and to door frame 14 and rear panel 20 by first, second, third and fourth grooved frame members 34, 36, 38 and 40. Specifically, each of the first side panels 30 is connectable to door frame 14 by a first grooved frame member 34 having a projection 42 along one edge for insertion into a corresponding groove 44 in door frame 14. First grooved frame member 34 further has a groove 46 along the opposite edge into which one of the first side panels 30 is inserted. Second grooved frame member 36 has a groove 48 along the one edge into which one of the first side panels 30 is inserted, and a projection 50 along the opposite edge for insertion into a groove 52 on one edge of third grooved frame member 38. Third grooved frame member 38 further has a groove 54 along the opposite edge for receiving one of the second side panels 32. Fourth grooved frame member 40 has a groove 56 along one edge into which one of the second side panels 32 is inserted, and a projection 58 along the opposite edge for insertion into a corresponding groove 60 in rear panel 20.

Each of the second side panels 32 (FIG. 5) includes a bracket or French support cleat 62 on an interior side of the second side panel 32 for receiving a bench seat 66 attached to rear panel 20. One of the first or second side panels 30, 32 includes a two-plug electric outlet 68 wired through the exterior of the second side panel 32 to a six foot long cord 73 with a three prong plug.

Figure 9:
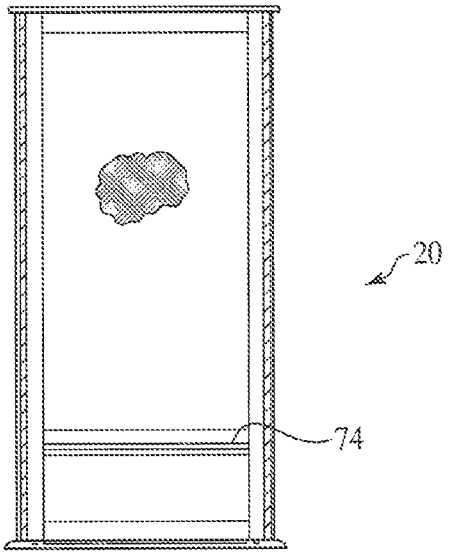
FIG. 9 shows an interior view of the rear panel according to embodiments of the invention.

Rear panel 20, shown in FIG. 9, includes a bracket or French cleat 74 to support bench seat 66 and rear upholstered cushioning 76. Bench seat 66 is drop mounted to rear panel 20, and both side panels by French cleats, and is a full-width vinyl upholstered seat having a reinforced core with cushioning.

Figure 10:
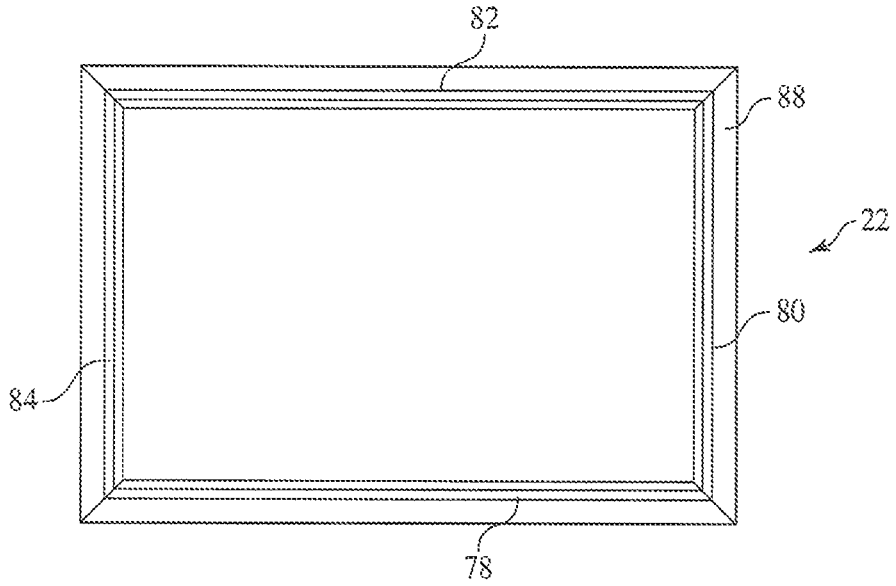
FIG. 10 shows a top view of the base according to embodiments of the invention.
Figure 11:
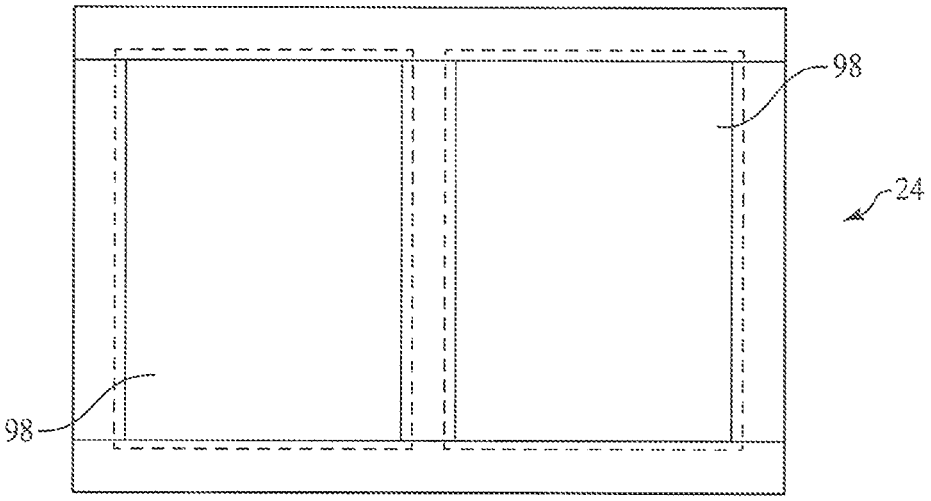
FIG. 11 shows a top view of the ceiling unit according to embodiments of the invention.

Base 22, as shown in FIG. 10, has first, second, third and fourth grooves 78, 80, 82, 84 for accepting front panel 11, first and second side panel assemblies 16, 18 and rear panel 20. The floor 86 of base 22 is preferably composed of solid plywood covered with vinyl flooring. Base 22 further includes base molding 88 and four support brackets (not shown) for securing front panel 11, first and second side panel assemblies 16, 18 and rear panel 20 to base 22.

The ceiling unit 24 (FIG. 11) includes a crown molding 100 for confining front panel 11, first and second side panel assemblies 16, 18 and rear panel 20. Crown molding 100 of ceiling unit 24 contains front panel 11, first and second side panel assemblies 16, 18 and rear panel 20 by having interior sides of crown molding 100 contacting the exterior sides of the top of front panel 11, first and second side panel assemblies 16, 18 and rear panel 20. Ceiling unit 24 preferably has white plastic lighting screens 98 to enhance ambient lighting and allow ventilation.

As shown in FIG. 1-9, front panel 11, first and second side panel assemblies 16, 18 and rear panel 20 are preferably composed of a veneered or laminated light weight composite material having a honeycomb structure to reduce weight and maintain strength. The grooved frame members 34, 36, 38, 40 are preferably furniture grade 1¼" wood. Front panel 11, first and second side panel assemblies 16, 18 and rear panel 20 all removably interlock with each other through the use of grooved frame members 34, 36, 38, 40 and the base 22 and ceiling unit 24 in order to make the lactation enclosure 10 readily collapsible.

According to embodiments of the invention, the lactation enclosure 10 is designed to be assembled by one or two people in less than 30 minutes with the panels being removably interlocking connected without tools. All panels are a lightweight material but strong with wood laminate and fit together in sequence. Strength and rigidity is enhanced by bench seat 66, support brackets and ceiling unit 24. The lactation enclosure 10 may be disassembled and moved/shipped as usage demands change over time. When collapsed, the door 12 and door frame assembly 14, side panel assemblies 16, 18, rear panel 20, base 22 and ceiling unit 24 are roughly 42" wide, 80" long and 20" deep. Estimated weight is 250 pounds. Total assembled lactation enclosure 10 is 3'6"×4'6" and 7' in height.

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Nothing in the above description is meant to limit the invention to any specific formulation, calculation, or methodology. Many formulation, calculation and methodology substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the described invention. Accordingly, it is understood that the drawings and the descriptions herein are proffered only to facilitate comprehension of the invention and should not be construed to limit the scope thereof.

What is claimed is:

1. A collapsible lactation enclosure comprising:
an upstanding front panel;
an upstanding rear panel opposite the front panel;
upstanding first and second side panel assemblies each removably interlockingly connected to the front panel and the rear panel;
a base; and
a ceiling unit;
a seating unit configured to be attachable to the first and second side panel assemblies and the rear panel;
a table unit configured to be attachable to at least one of the first and second side panel assemblies, and configured to support a breast pump;
an electrical outlet on the at least one of the first and second side panel assemblies configured to provide electricity to a breast pump;
wherein the front panel, the rear panel, and first and second side panel assemblies are removably interlockingly connected to the base and ceiling unit to form a collapsible lactation enclosure;
wherein the front panel comprises a door frame and a door assembly;
wherein each of the first and second side panel assemblies comprises a first side panel, a second side panel, and first, second, third and fourth grooved framing members;
wherein the first grooved framing member is removably interlockingly connected to the first side panel and is configured to removably interlockingly connect the first side panel and the front panel;
wherein the second grooved framing member is removably interlockingly connected to the first side panel,
wherein the second grooved framing member is configured to removably interlockingly connect to the third grooved framing member;
wherein the third grooved framing member is removably interlockingly connected to the second side panel;
wherein the fourth grooved framing member is removably interlockingly connected to the second side panel and is configured to removably interlockingly connect the second side panel and the rear panel.

2. The collapsible lactation enclosure of claim 1, wherein the base has a plurality of grooves each for receiving the front panel, the rear panel, and first and second side panel assemblies.

3. The collapsible lactation enclosure of claim 1, further comprising a bracket on each of the first and second side panel assemblies and the rear panel for supporting the seating unit.

4. The collapsible lactation enclosure of claim 1, wherein the ceiling unit further comprises at least one diffuser panel.

5. The collapsible lactation enclosure of claim 1, wherein the ceiling unit has a crown molding for containing the front panel, the rear panel, and first and second side panel assemblies.

* * * * *